US010001736B2

(12) United States Patent
Yamagishi et al.

(10) Patent No.: US 10,001,736 B2
(45) Date of Patent: Jun. 19, 2018

(54) FIXING DEVICE AND IMAGE FORMING APPARATUS

(71) Applicant: KYOCERA Document Solutions Inc., Osaka (JP)

(72) Inventors: Yoshihiro Yamagishi, Osaka (JP); Takashi Eiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/672,481

(22) Filed: Aug. 9, 2017

(65) Prior Publication Data

US 2018/0059597 A1 Mar. 1, 2018

(30) Foreign Application Priority Data

Aug. 30, 2016 (JP) ..... 2016-168490

(51) Int. Cl.
*G03G 15/20* (2006.01)

(52) U.S. Cl.
CPC ..... *G03G 15/2078* (2013.01); *G03G 15/2053* (2013.01); *G03G 15/2067* (2013.01); *G03G 2215/2009* (2013.01); *G03G 2215/2019* (2013.01)

(58) Field of Classification Search
CPC ..... G03G 15/2053; G03G 15/2064; G03G 15/2067; G03G 15/2078; G03G 2215/2009; G03G 2215/2019; G03G 2215/2022; G03G 2215/2035
See application file for complete search history.

(56) References Cited

U.S. PATENT DOCUMENTS

| | | | | |
|---|---|---|---|---|
| 7,142,803 | B2 | 11/2006 | Koyama et al. | |
| 2013/0170880 | A1* | 7/2013 | Gotoh | G03G 15/2053 399/329 |
| 2014/0016972 | A1* | 1/2014 | Seshita | G03G 15/2064 399/329 |
| 2014/0064804 | A1* | 3/2014 | Yamaguchi | G03G 15/2053 399/329 |
| 2014/0153983 | A1* | 6/2014 | Fujii | G03G 15/2053 399/329 |

(Continued)

FOREIGN PATENT DOCUMENTS

| | | |
|---|---|---|
| JP | 2005-202374 A | 7/2005 |
| JP | 2011-128278 A | 6/2011 |

*Primary Examiner* — Sophia S Chen
(74) *Attorney, Agent, or Firm* — Studebaker & Brackett PC

(57) ABSTRACT

A fixing device includes a fixing belt, a pressuring roller pressured to the fixing belt, a heat source heating the fixing belt, a pressing member pressing the fixing belt toward the pressuring roller's side, and a sliding contact sheet interposed between the fixing belt and the pressing member to hold lubricant. The sliding contact sheet includes a sliding contact portion arranged at the center in a sheet conveying direction to come into contact with the fixing belt, a first fixed portion arranged at an upstream side in the conveying direction and wound around the pressing member at the heat source's side, and a second fixed portion arranged at a downstream side in the conveying direction and wound around the pressing member at the heat source's side from the first fixed portion. The sliding contact sheet is configured so that the second fixed portion becomes smaller than the first fixed portion.

12 Claims, 5 Drawing Sheets

(56) References Cited

U.S. PATENT DOCUMENTS

| | | | | |
|---|---|---|---|---|
| 2015/0346663 | A1* | 12/2015 | Yamagishi | G03G 15/2064 399/329 |
| 2016/0334741 | A1* | 11/2016 | Takahashi | G03G 15/2053 |
| 2017/0102646 | A1* | 4/2017 | Ikebuchi | G03G 15/2025 |
| 2017/0131664 | A1* | 5/2017 | Utsunomiya | |

* cited by examiner

FIXING DEVICE AND IMAGE FORMING APPARATUS

INCORPORATION BY REFERENCE

This application is based on and claims the benefit of priority from Japanese Patent application No. 2016-168490 filed on Aug. 30, 2016, the entire contents of which are incorporated herein by reference.

BACKGROUND

The present disclosure relates to a fixing device fixing a toner image onto a sheet and an image forming apparatus including this fixing device.

Conventionally, an image forming apparatus of an electrographic manner, such as a copying machine or a printer, includes a fixing device fixing a toner image onto a sheet.

For example, the fixing device may include an endless belt (a fixing belt) coming into contact with a roller and rotating by following the roller, and a heat source arranged inside any one of the roller and the endless belt. The fixing device includes a pressuring member (a pressing member) pressuring the endless belt to the roller inside the endless belt. The pressuring member includes a sliding layer at a side coming into contact with the endless belt. The sliding layer includes at least two or more layers to hold a lubricant.

Alternatively, the fixing device may include a heating roller and a fixing belt circumscribing each other so as to form a fixing nip, a rubber pressing member, a resin pressing member, a sliding sheet, and an electric conductive sheet. The electric conductive sheet is arranged between the sliding sheet and a contact portion of the rubber pressing member and the resin pressing member.

In the above-mentioned fixing device, in order to prevent damage of a pressuring roller and a driving part thereof, a sliding layer of a roller (the pressuring roller) is made to hold the lubricant. Accordingly, friction resistance of the pressuring roller and the fixing belt is reduced and load torque of the fixing belt is reduced. Moreover, the fixing belt may be configured so that the above-mentioned sliding sheet (a sliding contact sheet) is made to hold the lubricant, in order to reduce friction resistance of the pressuring roller and a pressing member pressuring the pressuring roller to the fixing belt. The sliding contact sheet is attached so that a center sliding contact portion thereof is interposed between the pressing member and the pressuring roller and an end portion thereof is wound around the pressing member.

Incidentally, inside the fixing device, the heat source heating the fixing belt at an opposite side to a contact position with the pressuring roller, and a supporting member supporting the fixing belt. The fixing belt is heated by the heat source. Temperature of the fixing belt does not exceed 200 degrees centigrade at the contact position with the pressuring roller, but the fixing belt becomes high temperature at a heated position at the opposite side. The supporting member is arranged at the opposite side (a heated side) to the contact position of the fixing belt and the pressuring roller, with respect to the pressing member. Because the supporting member is made of metal or the like in order to secure strength, the supporting member is heated to high temperature (e.g. 250 degrees centigrade or more) by the heat source. Therefore, the sliding contact sheet is heated at a side of the end portion wound around the pressing member rather than a side of a sliding face.

Because the lubricant held by the sliding contact sheet is made of silicon-based or fluorine-based heat-resistant oil or grease, the lubricant has a quality of evaporating when it exceeds 250 degrees centigrade. Because the lubricant is used so that the sheet is impregnated with the lubricant, if a part of the lubricant becomes high temperature, the whole lubricant becomes high temperature by transmission of temperature rise, and then, it is feared that the lubricant is dried up by evaporating. Subsequently, if the lubricant is dried up, it is feared that friction resistance of the sliding contact sheet and the fixing belt is increased, and then, malfunction of the fixing belt, such as increase of load torque and rotation failure, is caused.

SUMMARY

In accordance with an embodiment of the present disclosure, a fixing device includes a fixing belt, a pressuring roller, a heat source, a pressing member and a sliding contact sheet. The fixing belt is rotatably arranged. The pressuring roller is pressured to the fixing belt to form the fixing nip and is rotatably arranged. The heat source heats the fixing belt. The pressing member presses the fixing belt toward a side of the pressuring roller. The sliding contact sheet is interposed between the fixing belt and the pressing member and holds a lubricant. The sliding contact sheet includes a sliding contact portion, a first fixed portion and a second fixed portion. The sliding contact portion is arranged at the center in a sheet conveying direction and comes into contact with the fixing belt. The first fixed portion is arranged at an upstream side in the conveying direction and is wound around the pressing member at a side of the heat source. The second fixed portion is arranged at a downstream side in the conveying direction and is wound around the pressing member at the side of the heat source from the first fixed portion. The sliding contact sheet is configured so that an area of the second fixed portion becomes smaller than an area of the first fixed portion.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
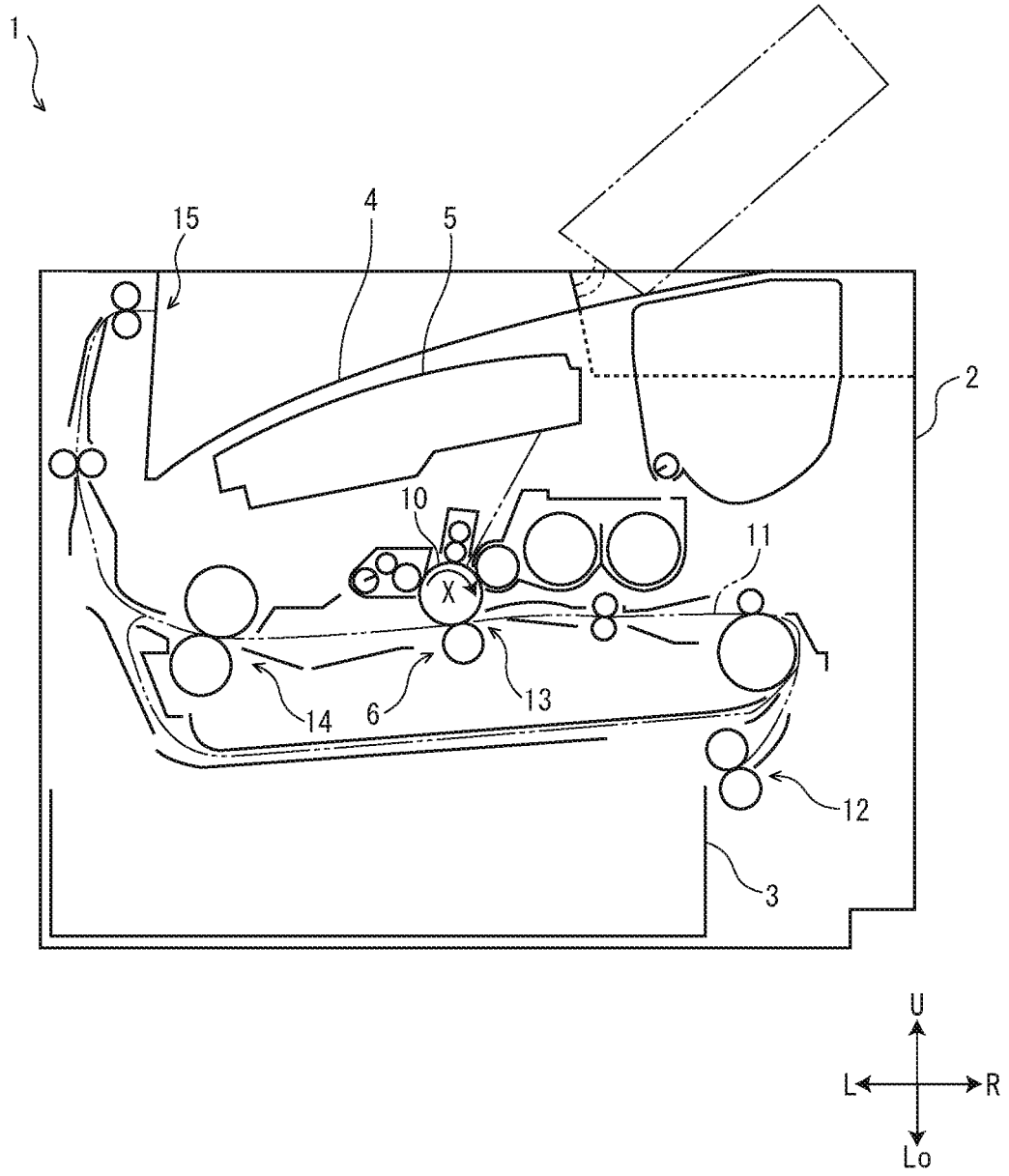
FIG. 1 is a sectional view schematically showing a printer according to an embodiment of the present disclosure.

First, with reference to FIG. 1, the entire structure of a printer 1 (an image forming apparatus) will be described. Arrows Fr, Rr, L, R, U and Lo in each of the drawings respectively indicate a front side, a rear side, a left side, a right side, an upper side and a lower side of the printer 1.

The printer 1 includes a box-like formed printer body 2. In a lower part of the printer body 2, a sheet feeding cartridge 3 storing sheets is installed. In an upper face of the printer body 2, an ejected sheet tray 4 is formed.

In an upper part inside the printer body 2, an exposure device 5 composed of a laser scanning unit (LSU) is located. Below the exposure device 5, an image forming part 6 is arranged. In the image forming part 6, a photosensitive drum 10 as an image carrier is rotatably arranged. Around the photosensitive drum 10, a charging device, a development device, a transfer roller and a cleaning device are located along a rotating direction (refer to an arrow X in FIG. 1) of the photosensitive drum 10.

Inside the printer body 2, a conveying path 11 for the sheet is arranged. At an upstream end of the conveying path 11, a sheet feeding part 12 is positioned. At an intermediate stream part of the conveying path 11, a transferring part 13 composed of the photosensitive drum 10 and the transfer roller is positioned. At a downstream part of the conveying path 11, a fixing device 14 is positioned. At a downstream end of the conveying path 11, a sheet ejecting part 15 is positioned.

Next, image forming operation of the printer 1 including such a configuration will be described. In the printer 1, when image data is inputted and a printing start is directed from an external computer or the like connected with the printer 1, image forming operation is started. First, in the image forming part 6, the surface of the photosensitive drum 10 is electrically charged by the charging device, and then, is exposed on the basis of the image data by the exposure device 5, thereby forming an electrostatic latent image on the surface of the photosensitive drum 10. Subsequently, the electrostatic latent image is developed to a toner image by the development device connected to a toner container.

On the other hand, the sheet picked up from the sheet feeding cartridge 3 by the sheet feeding part 12 is conveyed to the transferring part 13 in a given timing. In the transferring part 13, the toner image on the photosensitive drum 10 is transferred onto the sheet. The sheet with the transferred toner image is conveyed to a downstream side in the conveying path 11 to go into the fixing device 14. In the fixing device 14, the toner image is fixed on the sheet. The sheet with the fixed toner image is ejected from the sheet ejecting part 15 to the sheet ejected tray 4. Incidentally, in the image forming part 6, the toner remained on the photosensitive drum 10 is collected by the cleaning device.

Figure 2:
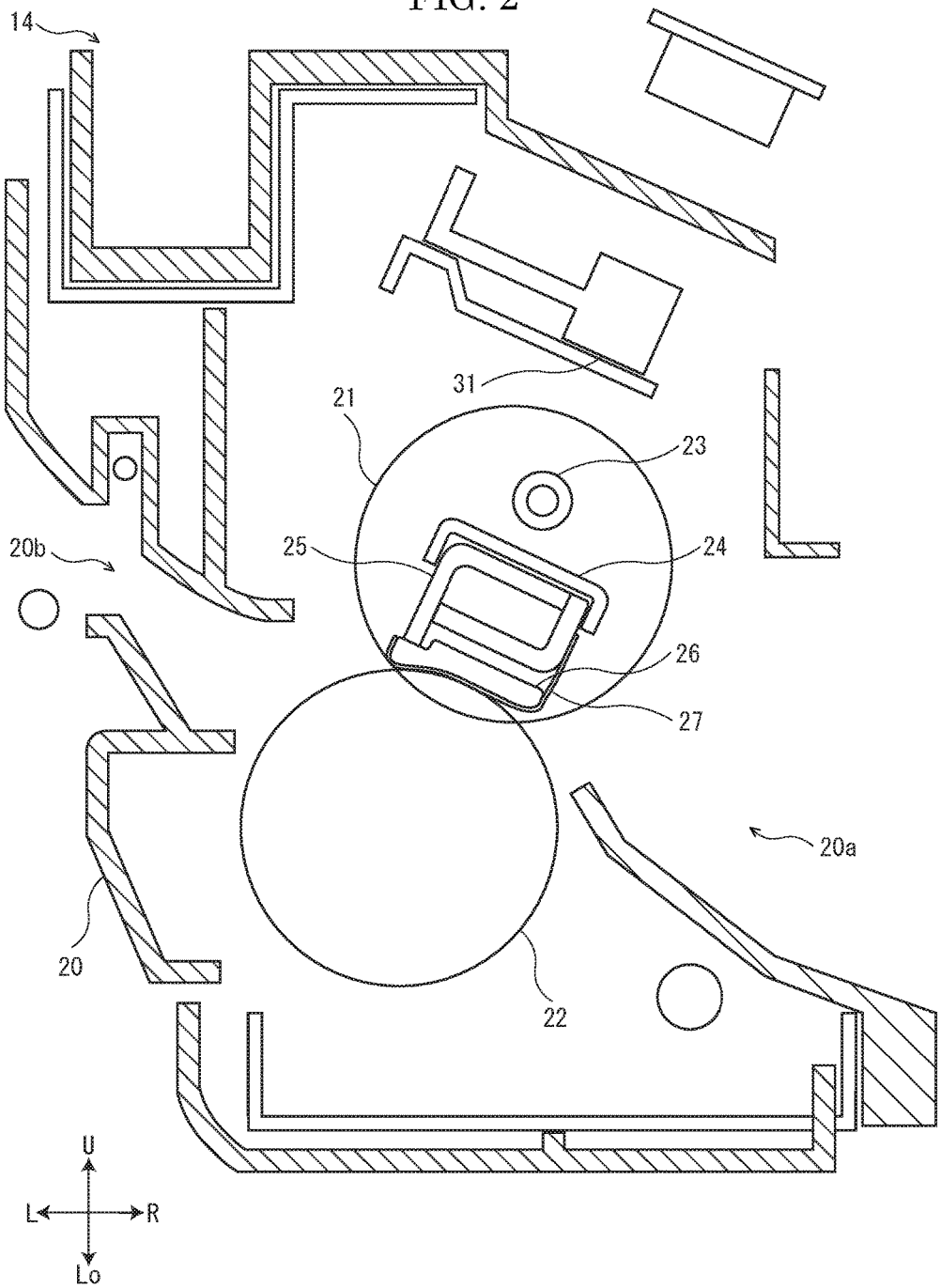
FIG. 2 is a sectional view showing a fixing device according to the embodiment of the present disclosure.
Figure 3:
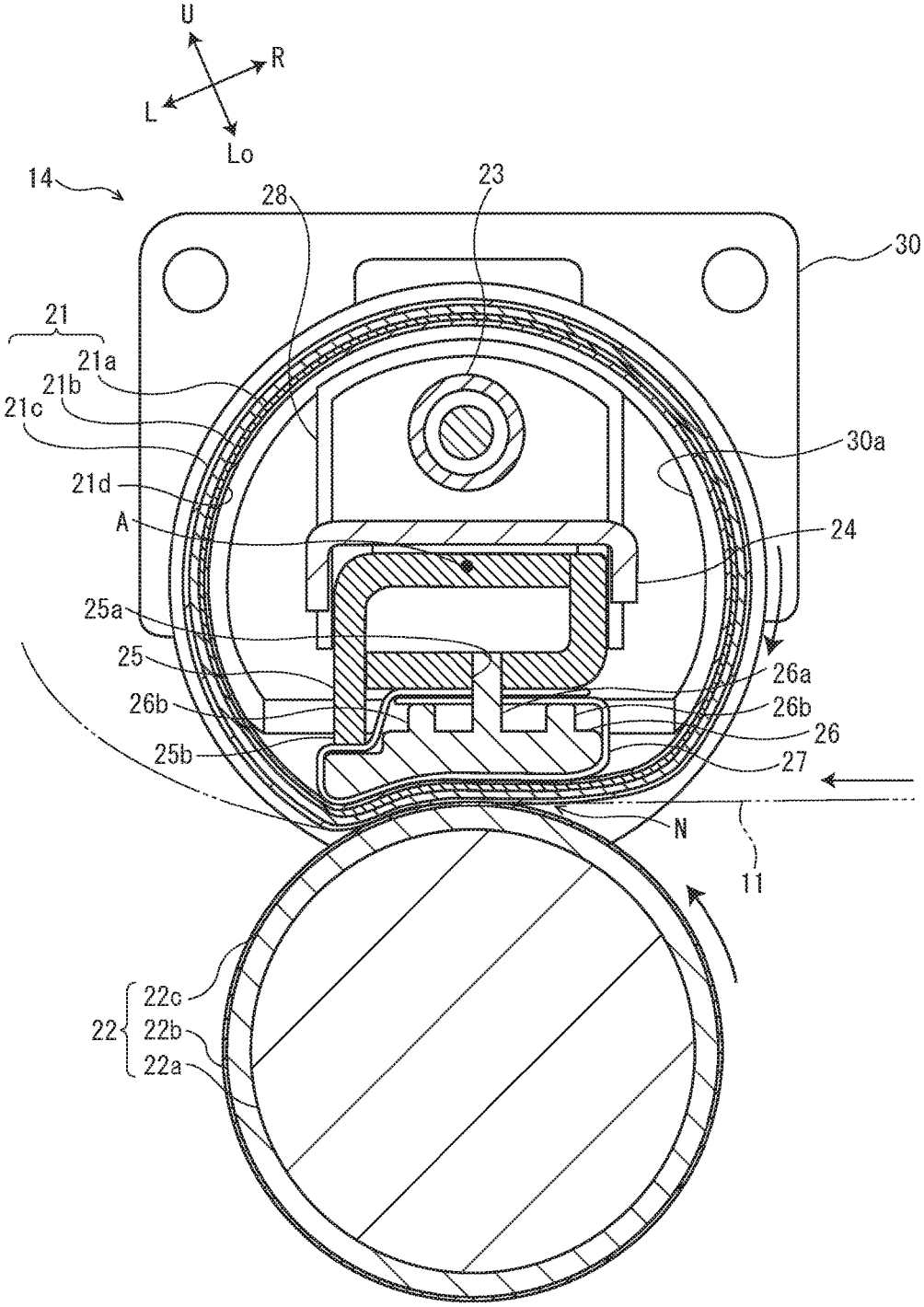
FIG. 3 is a sectional view showing details of the fixing device according to the embodiment of the present disclosure.

Next, the fixing device 14 will be described with reference to FIG. 2 to FIG. 5. As shown in FIG. 2 and FIG. 3, the fixing device 14 includes a frame 20, a fixing belt 21, a pressuring roller 22, a heater 23 (a heat source), a reflective plate 24, an internal supporting member 25 (a supporting member), a nip forming member 26 (a pressing member), a sliding contact sheet 27, cover members 28, shape regulating members 30 and a temperature sensor 31.

The frame 20 is formed in a box-like shape. The frame 20 includes a sheet inlet port 20*a* positioned at a right side and a sheet outlet port 20*b* positioned at a left side. The frame 20 is attached to the printer body 2 so that the conveying path 11 penetrates the frame 20 to path through the inlet port 20*a* and the outlet port 20*b*.

The fixing belt 21 is formed in a roughly cylindrical shape elongated in a sheet width direction (forward and backward directions) orthogonal to in a sheet conveyance direction (left and right directions). The fixing belt 21 is an endless belt having flexibility. The fixing belt 21 is positioned in an upper part inside the frame 20. The fixing belt 21 is attached to be rotatable in the forward and backward directions as a rotation axis direction with respect to the frame 20. The fixing belt is rotated by following rotation of the pressuring roller 22.

The fixing belt 21 is composed of, for example, a base material layer 21*a*, an elastic layer 21*b* provided around the base material layer 21*a* and a release layer 21*c* covering the elastic layer 21*b*. The base material layer 21*a* is made of, for example, metal, such as steel use stainless (SUS). The elastic layer 21*b* is made of, for example, a silicone rubber and has a thickness of, for example, 270 μm. The release layer 21*c* of the fixing belt 21 is made of, for example, a fluorine-based coating or tube, e.g. a PFA (Perfluoro alkoxy alkane) tube and has a thickness of, for example, 20 μm. On an inner circumference face (of the base material layer 21*a*) of the fixing belt 21, a coating layer 21*d* is provided in order to improve sliding performance and heat absorbing performance of the fixing belt 21.

The pressuring roller 22 is formed in a roughly columnar shape elongated in the sheet conveyance direction (the forward and backward directions). The pressuring roller 22 is positioned in a lower part inside the frame 20 at an outer diameter side (a left lower side) of the fixing belt 21. The pressuring roller 22 is pressured to the fixing belt 21 so that a fixing nip N is formed between the fixing belt 21 and the pressuring roller 22. The pressuring roller 22 is attached to be rotatable in the forward and backward directions as a rotation axis direction with respect to the frame 20. The pressuring roller 22 is rotated by a driving source (not shown), such as a motor.

The pressuring roller 22 is composed of, for example, a columnar core material 22*a*, an elastic layer 22*b* provided around the core material 22*a* and a release layer 22*c* covering the elastic layer 22*b*. The core material 22*a* is made of, for example, metal material, such as iron. The elastic layer 22*b* is made of, for example, a silicone rubber. The release layer 22*c* is made of, for example, PFA tube.

The heater 23 is composed of, for example, a halogen heater, a ceramic heater or the like. The heater is arranged on a vertical line passing through a rotation center A of the fixing belt 21 with respect to the conveying path 11 in an internal space of the fixing belt 21. For example, the heater 23 is positioned in a right upper part (a part separated from the pressuring roller 22) of the internal space of the fixing belt 21 and is arranged at a position shifted at a right upper side (a side separated from the pressuring roller 22) with respect to the rotation center A of the fixing belt 21. That is, the heater 23 is positioned most closely to the right upper side of the fixing belt 21 and configured to heat the right upper side of the fixing belt 21 over the forward and backward directions.

The reflective plate 24 is formed in a plate shape having a longitudinal direction of the forward and backward directions and a lateral direction of the conveyance direction along the conveying path 11. Both ends of the reflective plate 24 in the conveyance direction are bent toward the pressuring roller 22's side. The reflective plate 24 is arranged at the pressuring roller 22's side (the left lower side) from the heater 23 in the internal space of the fixing belt 21, for example, in a state that an upper face thereof as a reflective face is faced to the heater 23's side. In other words, the reflective plate 24 is positioned between the heater 23 and the internal supporting member 25. Then, the reflective plate 24 is configured so that radiant heat radiated from the heater 23 to the pressuring roller 22's side is reflected toward the right upper side of the fixing belt 21.

The internal supporting member 25 is formed in a square cylinder shape elongated in the forward and backward directions by metal material, such as iron or SUS. For example, the internal supporting member 25 may be configured by combining a pair of metal plates of L shaped cross section. The internal supporting member 25 is arranged at the pressuring roller 22's side (the left lower side) from the reflective plate 24 in the internal space of the fixing belt 21, for example, in a state that an upper face thereof is faced to the heater 23's side (the right upper side of the fixing belt 21) and a lower face thereof is faced to the pressuring roller 22's side. In other words, the internal supporting member 25 is positioned between the reflective plate 24 and the nip forming member 26.

The upper face of the internal supporting member 25 supports, for example, a lower face of the reflective plate 24 via a spacer. The lower face of the internal supporting member 25 has a plurality of supporting holes 25*a* at intervals in the forward and backward directions. At a left end of the lower face of the internal supporting member 25, a projecting part 25*b* projecting to the pressuring roller 22's side is provided. Both ends of the internal supporting member 25 in the forward and backward directions are attached to the frame 20.

The nip forming member 26 is formed in a plate shape elongated in the forward and backward directions by heat resistant material, such as LCP (Liquid Crystal Polymer), PEEK (Polyether ether ketone) or PPS (Polyphenylene Sulfide). The nip forming member 26 is formed, for example, so that a left side portion of a lower face thereof is inclined from the right side (an upstream side in the conveyance direction) to the left side (a downstream side in the conveyance direction) toward the lower side (the pressuring roller 22's side). The nip forming member 26 is arranged at the pressuring roller 22's side (the left lower side) from the internal supporting member 25 in the internal space of the fixing belt 21, for example, in a state that an upper face thereof is faced to the heater 23's side (the right upper side of the fixing belt 21) and a lower face thereof is faced to the pressuring roller 22's side. In other words, the nip forming member 26 is positioned between the internal supporting member 25 and the left lower side of the fixing belt 21.

On the upper face of the nip forming member 26, a plurality of first protruding parts 26*a* (protruding parts) are provided at the center in the conveyance direction at intervals in the forward and backward directions and a plurality of second protruding parts 26*b* lower than the first protruding parts 26*a* are provided at both sides of the first protruding parts 26*a* in the conveyance direction at intervals in the forward and backward directions. By inserting the plurality of first protruding parts 26*a* into the plurality of supporting holes 25*a* of the internal supporting member 25, the nip forming member 26 is positioned and fixed to the internal supporting member 25. Further, by making leading ends of the plurality of second protruding parts 26*b* come into contact with the lower face of the internal supporting member 25 and making a left end of the upper face of the nip forming member 26 come into contact with the projecting part 25*b* of the internal supporting member 25, the nip forming member 26 is supported by the internal supporting member 25. Moreover, the lower face of the nip forming member 26 presses a left lower side portion (a portion at the pressuring roller 22's side) of the inner circumference face (the coating layer 21*d*) of the fixing belt 21 to the left lower side (the pressuring roller 22's side) via the sliding contact sheet 27.

The sliding contact sheet 27 is formed in a roughly rectangular cloth-like sheet having a longitudinal direction of the forward and backward directions and a lateral direction of the conveyance direction and has flexibility. The sliding contact sheet 27 is made of a fluorine-based fiber or a fluorine-based sheet.

Figure 4:
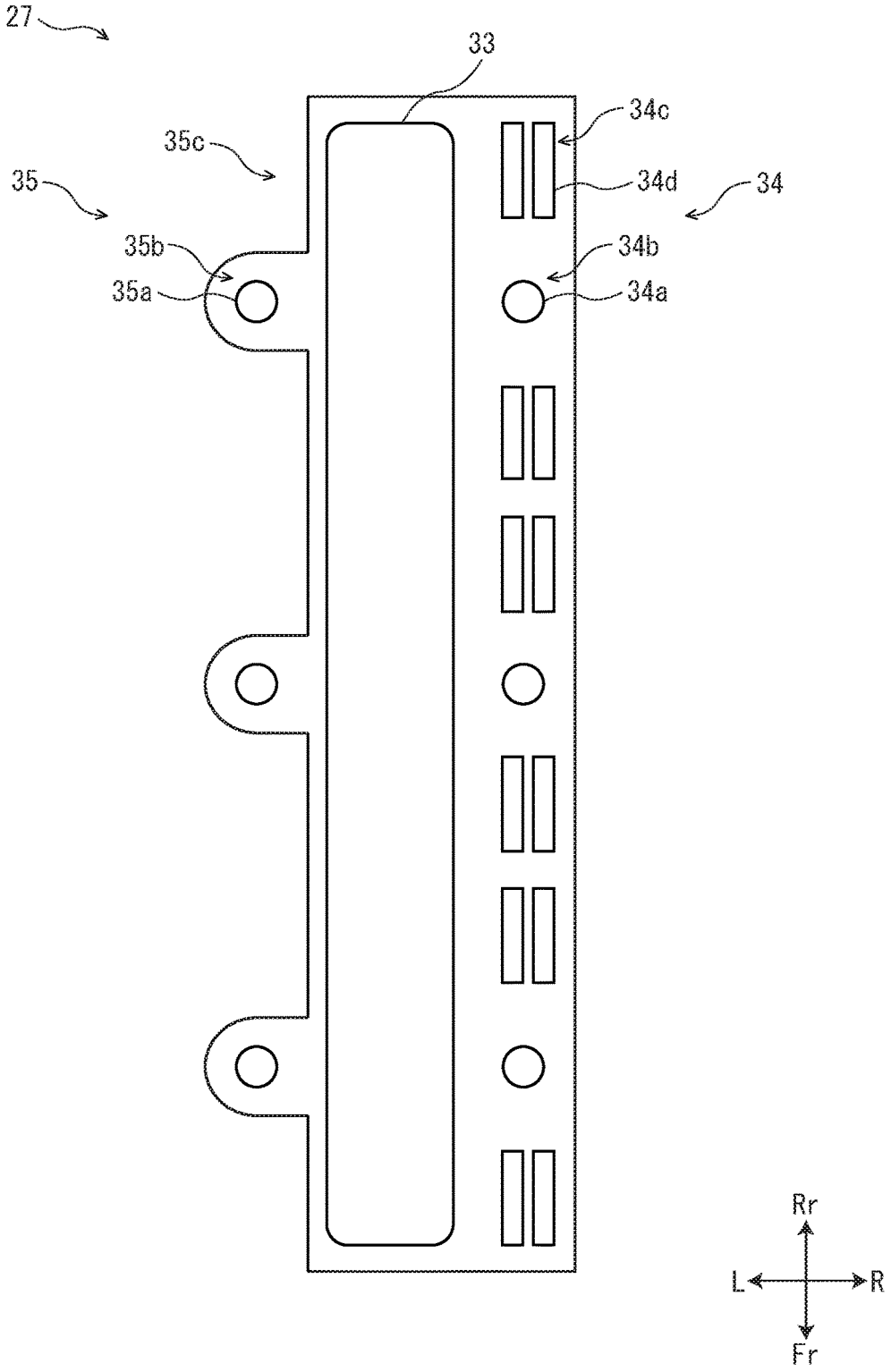
FIG. 4 is a plane view showing a sliding contact sheet of the fixing device according to the embodiment of the present disclosure.
Figure 5:
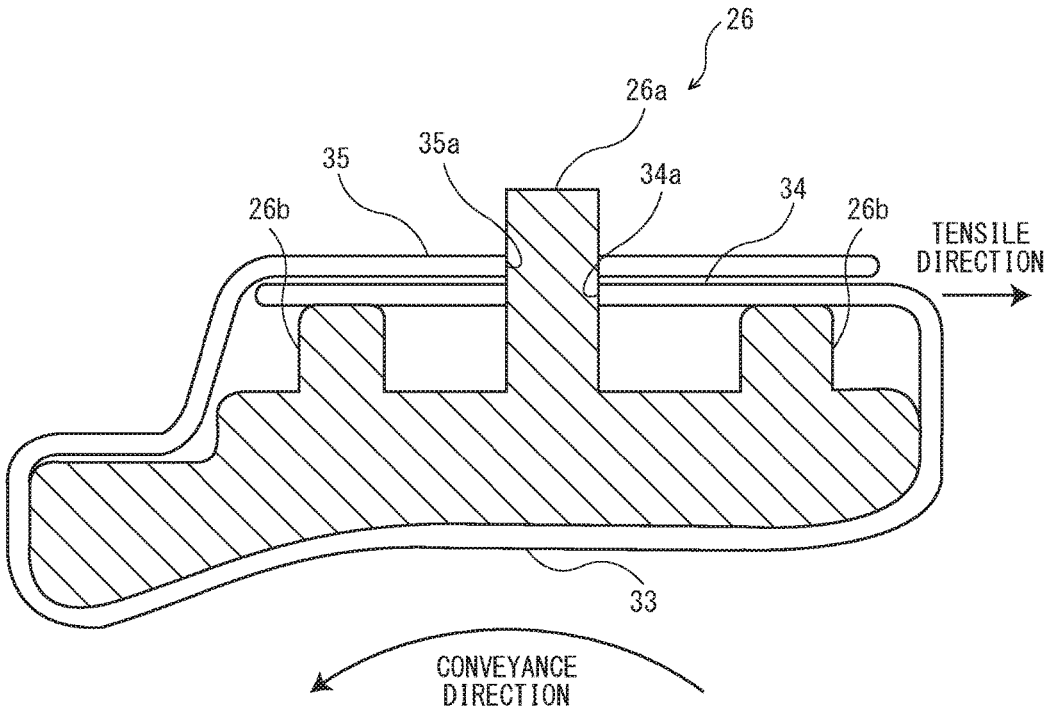
FIG. 5 is a sectional view showing a nip forming member and the sliding contact sheet of the fixing device according to the embodiment of the present disclosure.

The sliding contact sheet 27 includes, as shown in FIG. 4, a rectangular sliding contact portion 33 over the forward and backward directions at the center in the conveyance direction. The sliding contact sheet 27 includes a first fixed portion 34 at the upstream side (the right side) in the conveyance direction and a second fixed portion 35 at the downstream side (the left side) in the conveyance direction. The sliding contact sheet 27 is arranged in the internal space of the fixing belt 21 so as to correspond the sliding contact portion 33 to the lower face of the nip forming member 26. In a state that the sliding contact sheet 27 is attached to the nip forming member 26, rotation in the conveyance direction of the fixing belt 21 being contact with the sliding contact portion 33 brings a tensile force in a tensile direction of the upstream side (the right side) in the conveyance direction, and then, the first fixed portion 34 is a portion to which the tensile force is applied and the second fixed portion 35 is a portion to which the tensile force is not applied.

The first fixed portion 34 includes a plurality of first fixed holes 34*a* at intervals in the forward and backward directions and includes lightening holes 34*d* in regions 34*c* except for holding regions 34*b* holding the first fixed holes 34*a*. The sliding contact sheet 27 is configured so that an area of the first fixed portion 34 becomes smaller than an area of the sliding contact portion 33. Incidentally, the plurality of first fixed holes 34*a* have respective sizes capable of fitting the plurality of first protruding parts 26*a* of the nip forming member 26 and are provided so as to correspond to the respective first protruding parts 26*a*.

The second fixed portion 35 includes a plurality of second fixed holes 35*a* (fixed holes) at intervals in the forward and backward directions and includes notches 35*c* in regions except for holding regions 35*b* holding the second fixed holes 35*a*. The sliding contact sheet 27 is configured so that an area of the second fixed portion 35 becomes smaller than respective areas of the first fixed portion 34 and the sliding contact portion 33. Incidentally, the plurality of second fixed holes 35*a* have respective sizes capable of fitting the plurality of first protruding parts 26*a* of the nip forming member 26 and are provided so as to correspond to the respective first protruding parts 26*a*. The holding region 35*b* holding each second fixed hole 35*a* is formed in a shape (e.g. semicircular, rectangular or the like) elongated from the sliding contact portion 33 to the downstream side (the left side) in the conveyance direction at a position corresponding to each first protruding part 26*a*

In a state that the sliding contact portion 33 is positioned on the lower face of the nip forming member 26, by overlapping the first fixed portion 34 onto the upper face of the nip forming member 26 and by fitting each first protruding part 26*a* into each first fixed hole 34*a*, the sliding contact sheet 27 is positioned at the upstream side in the conveyance direction. Further, by overlapping the second fixed portion 35 onto the first fixed portion 34 and by fitting each first protruding part 26*a* into each second fixed hole 35*a*, the sliding contact sheet 27 is positioned at the downstream side in the conveyance direction. Thereby, the sliding contact sheet 27 is attached and fixed to the nip forming member 26.

In a state that the sliding contact sheet 27 is attached to the nip forming member 26, the sliding contact portion 33 comes into contact with the left lower side of the fixing belt 21. In other words, the sliding contact portion 33 of the sliding contact sheet 27 is interposed between the nip forming member 26 and the left lower side of the fixing belt 21. Moreover, the sliding contact sheet 27 holds a lubricant by application, impregnation or the like. The lubricant is, for example, silicon-based oil and is held over the whole (the sliding contact portion 33, the first fixed portion 34 and the second fixed portion 35) of the sliding contact sheet 27.

The cover members 28 are provided at both front and rear ends of the internal supporting member 25. Each cover member 28 is composed of a curved portion curved in an arcuate shape toward an upper side and attachment portions bent from both left and right ends (ends at the upstream side and the downstream side in the conveyance direction) of the curved portion toward the lower side. The curved portion of each cover member 28 is arranged along the inner circumference face of the fixing belt 21 and the attachment portions of each cover member 28 are attached to both left and right side faces of the internal supporting member 25.

The shape regulating members 30 are provided at both front and rear ends of the internal supporting member 25. Each shape regulating member 30 is arranged at the outside in the forward and backward directions from each cover member 28. The respective shape regulating members 30 include inserted portions 30*a* inserted into both front and rear ends of the fixing belt 21 from the outside in the forward and backward directions and are configured so as to hold ends in the axis direction of the fixing belt 21 and to regulate the shape of the fixing belt 21.

The temperature sensor 31 is arranged at the outer diameter of the fixing belt 21 (the side separated from the pressuring roller 22, e.g. the right upper side) in the upper part inside the frame 20. The temperature sensor 31 is provided in a non-contact state with the fixing belt 21. The temperature sensor 31 is composed of, for example, thermal cut-off component or the like and has a function sensing radiant heat radiated from the fixing belt 21.

In accordance with the embodiment, as described above, the fixing device 14 of the printer 1 (the image forming apparatus) includes the fixing belt 21, the pressuring roller 22, the heater 23 (the heat source), the nip forming member 26 (the pressing member) and the sliding contact sheet 27. The fixing belt 21 is rotatably arranged. The pressuring roller 22 is pressured to the fixing belt 21 to form the fixing nip N and is rotatably arranged. The heater 23 heats the fixing belt 21. The nip forming member 26 presses the fixing belt 21 toward the pressuring roller 22's side. The sliding contact sheet 27 is interposed between the fixing belt 21 and the nip forming member 26 and holds a lubricant. The sliding contact sheet 27 includes the sliding contact portion 33, the first fixed portion 34 and the second fixed portion 35. The sliding contact portion 33 is arranged at the center in the sheet conveying direction and comes into contact with the fixing belt 21. The first fixed portion 34 is arranged at the upstream side in the conveying direction and is wound around the nip forming member 26 at the heater 23's side. The second fixed portion 35 is arranged at the downstream side in the conveying direction and is wound around the nip forming member 26 at the heater 23's side from the first fixed portion 34. The sliding contact sheet 27 is configured so that the area of the second fixed portion 35 becomes smaller than the area of the first fixed portion 34.

According to this, in the sliding contact sheet 27, if the tensile force by rotation in the conveyance direction of the fixing belt 21 being contact with the sliding contact portion 33 is applied to the first fixed portion 34, the first fixed portion 34 can be attached to the nip forming member 26 with having the sufficient area for making no damage or the like due to the tensile force. On the other hand, since the tensile force by rotation in the conveyance direction of the fixing belt 21 being contact with the sliding contact portion 33 is not applied to the second fixed portion 35, it is possible to form the second fixed portion 35 by the smaller area than the first fixed portion 34 and others without considering damage or the like due to the tensile force. Accordingly, if the second fixed portion 35 is attached to the nip forming member 26 at a position in the sliding contact sheet 27 closest to the heater 23's side, since the area of the second fixed portion 35 is small, it is possible to reduce evaporation of the lubricant held by the sliding contact sheet 27. Therefore, it is possible to hardly dry up the lubricant held by the sliding contact sheet 27, to restrain increase of friction resistance of the sliding contact sheet 27 and the fixing belt 21, and prevent malfunction of the fixing belt 21, such as increase of load torque and rotation failure.

For example, in the above-described embodiment, the fixing device 14 is operated so that the heater 23 is set to 170 degrees centigrade, the fixing belt 21 and the pressuring roller 22 are rotated so that the sheets continuously pass through, and temperature of the sheet rises at most 240 degrees centigrade. Here, in a case where the sliding contact sheet 27 is impregnated with the lubricant as silicon oil of 0.8 ml, it is possible to obtain 20 percent or more improvement of driving time taken until the lubricant is dried up. Incidentally, drying up of the lubricant can be decided according to detection result of rotation driving torque of the pressuring roller 22.

In addition, in accordance with the embodiment, the nip forming member 26 includes the plurality of first protruding parts 26*a* (the protruding parts) protruding to the heater 23's side. The second fixed portion 35 includes the plurality of second fixed holes 35*a* (the fixed holes) into which the plurality of first protruding parts 26*a* are fitted. The second fixed portion 35 is formed to have the notches 35*c* except for holding regions 35*b* being elongated from the sliding contact portion 33 and holding the second fixed holes 35*a*. Thereby, by cutting out regions except for holding regions 35*b* as unnecessary portions for attachment, it is possible to form the second fixed portion 35 by the smaller area than the first fixed portion 34 and others.

Moreover, in accordance with the embodiment, the sliding contact sheet 27 is formed so that the area of the first fixed portion 34 becomes smaller than the area of the sliding contact portion 33. Thereby, since, in the sliding contact sheet 27, not only the second fixed portion 35 closest to the heater 23' side in the sliding contact sheet 27, but also the first fixed portion 34 second closest to the heater 23' side is formed by the small area, it is possible to more reduce evaporation of the lubricant held by the sliding contact sheet 27.

Further, in accordance with the embodiment, the first fixed portion 34 includes the lightening holes 34*d*. Thereby, the first fixed portion 34 can have an external area sufficient for attachment and can reduce the area by simple configuration.

Incidentally, although, in the embodiment, a configuration in which the fixing belt 21 and the pressuring roller 22 of the fixing device 14 are respectively arranged at the upper side and lower side across the conveying path 11 extended in the left and right directions was described, the configuration of the fixing device 14 is not restricted by this. For example, in another embodiment, the fixing belt 21 and the pressuring roller 22 may be respectively arranged at the right side and left side across the conveying path 11 extended in upward and downward directions.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

Further, the above-description of the embodiments was described about one example of the fixing device and the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A fixing device comprising:

a fixing belt rotatably arranged;

a pressuring roller pressured to the fixing belt to form a fixing nip and rotatably arranged;

a heat source heating the fixing belt;

a pressing member pressing the fixing belt toward a side of the pressuring roller; and a sliding contact sheet interposed between the fixing belt and the pressing member and holding a lubricant, wherein the sliding contact sheet includes:

a sliding contact portion arranged at a center in a sheet conveying direction and coming into contact with the fixing belt;

a first fixed portion arranged at an upstream side in the conveying direction and wound around the pressing member at a side of the heat source; and a second fixed portion arranged at a downstream side in the conveying direction and wound around the pressing member at the side of the heat source from the first fixed portion, the sliding contact sheet is configured so that an area of the second fixed portion becomes smaller than an area of the first fixed portion, the pressing member includes a first protruding part protruding to the side of the heat source, and the second fixed portion includes a fixed hole into which the first protruding part is fitted, and is formed to have a notch except for a holding region being elongated from the sliding contact portion and holding the fixed hole.

2. The fixing device according to claim 1, wherein the sliding contact sheet is formed so that the area of the first fixed portion becomes smaller than an area of the sliding contact portion.

3. An image forming apparatus comprising the fixing device according to claim 2.

4. The fixing device according to claim 1 further comprising:

a supporting member arranged between the heat source and the pressing member and having a face at the side of the pressuring roller and a supporting hole formed on the face, wherein the pressing member is positioned to the supporting member by inserting the first protruding part into the supporting hole.

5. The fixing device according to claim 4, wherein the pressing member includes a second protruding part lower than the first protruding part at both sides of the first protruding part in the conveyance direction, the pressing member is supported by the supporting member by making a leading end of the second protruding part come into contact with the face at the side of the pressuring roller of the supporting member.

6. An image forming apparatus comprising the fixing device according to claim 5.

7. The fixing device according to claim 4, wherein the supporting member includes a projecting part projecting to the side of the pressuring roller at the downstream side in the conveying direction, the pressing member is formed so that an end at the downstream side in the conveying direction is inclined from the upstream side in the conveyance direction to the downstream side in the conveyance direction toward the side of the pressuring roller, the pressing member is supported by the supporting member by making the end at the downstream side in the conveying direction come into contact with the projecting part.

8. An image forming apparatus comprising the fixing device according to claim 7.

9. An image forming apparatus comprising the fixing device according to claim 4.

10. An image forming apparatus comprising the fixing device according to claim 1.

11. A fixing device comprising:

a fixing belt rotatably arranged;

a pressuring roller pressured to the fixing belt to form a fixing nip and rotatably arranged;

a heat source heating the fixing belt;

a pressing member pressing the fixing belt toward a side of the pressuring roller; and a sliding contact sheet interposed between the fixing belt and the pressing member and holding a lubricant, wherein the sliding contact sheet includes:

a sliding contact portion arranged at a center in a sheet conveying direction and coming into contact with the fixing belt;

a first fixed portion arranged at an upstream side in the conveying direction and wound around the pressing member at a side of the heat source; and a second fixed portion arranged at a downstream side in the conveying direction and wound around the pressing member at the side of the heat source from the first fixed portion, the sliding contact sheet is configured so that an area of the second fixed portion becomes smaller than an area of the first fixed portion, the sliding contact sheet is formed so that the area of the first fixed portion becomes smaller than an area of the sliding contact portion, and the first fixed portion includes a lightening hole.

12. An image forming apparatus comprising the fixing device according to claim 11.

* * * * *